United States Patent [19]

Prikkel, III et al.

[11] 4,361,272

[45] Nov. 30, 1982

[54] THERMAL DAMPER FOR RECTANGULAR FLUE

[75] Inventors: John Prikkel, III, Dayton; Dale R. Booher; Jeffrey R. Killin, both of Fairborn, all of Ohio

[73] Assignee: Energy Vent, Inc., Dayton, Ohio

[21] Appl. No.: 251,213

[22] Filed: Apr. 6, 1981

[51] Int. Cl.[3] ..... F23N 3/00

[52] U.S. Cl. ..... 236/1 G; 236/49; 236/101 D; 374/206

[58] Field of Search ..... 236/1 G, 49, 93 R, 101 D; 251/305, 337; 137/454.2; 98/40 VT; 267/156, 59; 337/380; 73/363.7

[56] References Cited

U.S. PATENT DOCUMENTS

| | | | |
|---|---|---|---|
| 1,337,907 | 4/1920 | Hall | 236/93 R X |
| 1,659,875 | 2/1928 | Jacobs | 236/93 R |
| 2,959,933 | 11/1960 | Burke | 62/183 |
| 2,975,975 | 3/1961 | Weber | 236/49 |
| 3,273,798 | 9/1966 | Kuipper | 236/93 R |
| 3,366,333 | 1/1968 | Diehl | 236/93 R |
| 3,753,548 | 8/1973 | Jung et al. | 251/305 |
| 3,804,366 | 4/1974 | Rubright | 251/305 |
| 4,165,833 | 8/1979 | Nagel | 236/1 G |

FOREIGN PATENT DOCUMENTS

| | | | |
|---|---|---|---|
| 183926 | 4/1955 | Fed. Rep. of Germany | 236/93 R |

*Primary Examiner*—William E. Tapolcai
*Attorney, Agent, or Firm*—Dybvig & Dybvig

[57] ABSTRACT

A thermally responsive damper for operation in a rectangular ventilation duct.

7 Claims, 6 Drawing Figures

20
2
44
48
22
34
50
10
16
2
18
14
12

20
44
62
48
56
26
22
60
24
28
32
60
58
30
34
46
50
62

20
22
46
26
60
48
30
32
58
60
50
24
56
5
5
44
34

22
24
26
28

48
56
52
46
30
32
54
40
44
42
34
50
38
36

22
20
58

58
40
32
28
38
30
36

20a
26a
22a
48a
46a
32a
58a
50a
44a
56a
30a
34a

THERMAL DAMPER FOR RECTANGULAR FLUE

BRIEF SUMMARY OF THE INVENTION

A thermally responsive damper assembly, adapted for operation in a narrow rectangular ventilation duct, is fabricated by striking out portions of the base of a shaped channel member. One of the struck out portions is positioned and sized to interfit a latch member which cooperates with said one struck out portion to receive and retain the innermost convolution of a spirally convoluted bimetallic coil. The coil has a tab at its outermost convolution to which is riveted a vane provided with a centrally located arcuate section. This arcuate section partially surrounds said bimetallic coil and said vane has outwardly projecting wing portions sized to move freely in the space defined by side walls of said channel. By means of fasteners, or spot welding, the aforesaid channel is fixedly secured in the rectangular ventilation duct where the bimetallic coil, in response to the temperature of gases being ventilated, positions the vane thereto affixed in relation to the gas temperature, said vane when closing said duct being disposed substantially perpendicular to the side walls of said duct and when opening said duct being disposed generally parallel to the side walls of said duct.

In a modification, the wing portions are extended such that the ends of the wings abut side portions of the duct to more completely seal the duct at reduced temperatures.

DETAILED DESCRIPTION

Figure 1:
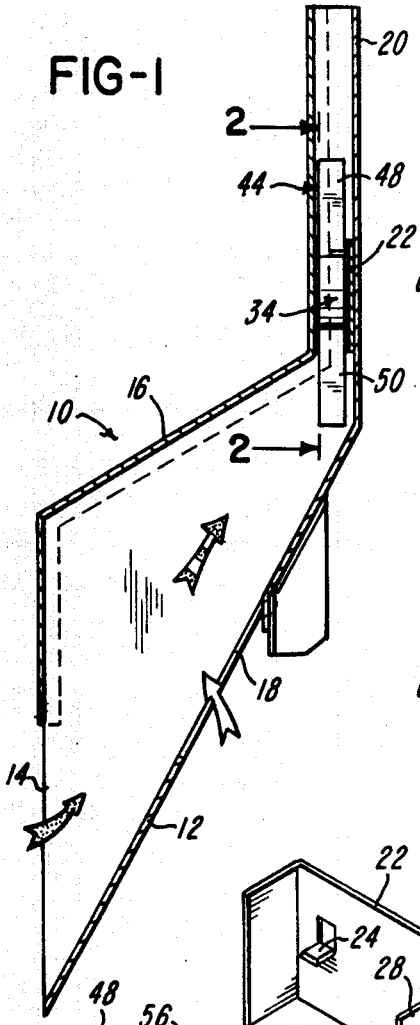
FIG. 1 is a section view taken longitudinally of a rectangularly shaped draft hood having an integrally formed and rectangularly shaped ventilation duct, the thermally responsive damper assembly of the present invention being mounted in the aforementioned ventilation duct.

Referring to the drawings in greater detail, FIG. 1 illustrates a draft hood 10 which is of a type utilized in connection with so-called wall furnaces, i.e. furnaces adapted to be installed in living quarters adjacent one of the walls confining such quarters. As indicated by broken lines in FIG. 1, the draft hood can be understood to comprise two pieces of sheet metal, a first piece 12 comprising the right side of the draft hood, as illustrated in FIG. 1, being of general U-shape in cross-section and a second piece 16 comprising a generally flat sheet metal member having its edges bent at a right angle so as to resemble a lid which covers the left-hand side of the piece 12. The furnace, which is not shown, is ordinarily floor mounted at a location generally below the draft hood 10 as the draft hood is shown in FIG. 1. Combustion products resulting from the combustion of fuel in the furnace are discharged from the furnace into the draft hood 10 through an opening 18. Ordinarily, the furnace would be equipped with heat exchange apparatus, not shown, which extracts heat from the products of combustion occurring in the furnace for purposes of heating the living quarters within which the furnace is located. The residue of the combustion product remaining after a substantial portion of the heat rendered available by combustion has been extracted from the combustion products flows generally upwardly through the draft hood to escape upwardly through a relatively restricted rectangular flue passageway 20. The rectangular shape of the flue 20 can be characterized as having a width dimension which is that space existing between the confronting faces of the sheet metal pieces 12 and 16, a length dimension which is the dimension between the side walls of the flue section and a depth dimension which corresponds to the vertical height of the flue 20 as it appears in FIG. 1. The design of the draft hood is such that the flue passageway 20 can be located in or may be adjacent one of the walls confining the living space served by the furnace.

The migration of the spent combustion products up the flue 20 is powered by a tendency of the spent combustion products to diffuse and rise upwardly because gravitationally less dense than the atmosphere located above the mouth of the flue 20. This upward flow of gases in the flue 20 tends to draw additional products of combustion through the opening 18. The resulting draft tends to draw the atmosphere of the living space being heated through the furnace and into the illustrated draft hood and, to prevent an excessive delivery of fresh air to the combustion zone of the furnace, the fraft hood is provided with a relatively large opening 14 in the lower leftward end thereof as the draft hood appears in FIG. 1. This opening 14 admits room air to the draft hood in partial satisfaction of the upward draft produced by the combustion products flowing upwardly from the furnace and into the draft hood 10 through the opening 18. The opening 14 thus functions in the nature of a draft diverter which diverts a portion of the draft produced by the upflow of combustion products through the flue 20 away from the opening 18 to the opening 14, with the consequence that the flow of room air through the furnace, not shown, is less vigorous than would be the case in the absence of the opening 14.

Ordinarily, the operation of the wall furnace is regulated by means of a thermostatic control located in the living space being heated by operation of the wall furnace.

A difficulty encountered with draft hoods of the type illustrated in FIG. 1 is that when the thermostatic demand for heat has been satisfied and combustion terminated, the spent combustion products still residing in the heat exchanger section of the furnace, not shown, continue their upward migration into and then upwardly through the flue 20. This perpetuates the updraft associated with the flue 20 and causes the adequately heated air in the living space to be drawn from the living space into the flue section 20 through both of the draft hood openings 14 and 18. In consequence of this continuing updraft condition, the very air which has enabled the thermostat to sense that its heat demand has been satisfied is being wastefully removed from the living premises and, in typical installations, replaced by cooler air located outside the premises being heated and drawn into the living quarters through door openings, wall fissures and the like. It is, of course, necessary that some of the air surrounding the living quarters be permitted to migrate in such living quarters so that the oxygen demands of the wall furnace being described can be satisfied. Of course, when the thermostatic heat demand has been satisfied, the oxygen demand in the living quarters reduces substantially and it is this reduction in living quarter oxygen demand that contributes to the wastefulness of the continuing updraft through the flue 20.

It is known in the art to employ damper devices coupled to the operation of a thermostat for closing, or substantially closing, a flue when the thermostatic heat demand has been satisfied, thus to conserve the heated atmosphere which has satisfied the thermostatic heat demand. Thus, and as a result of recent efforts to conserve energy consumption attributable to household heating, damper devices which close household flues in response to satisfaction of a thermostatic heat demand have been developed and marketed widely in the United States. Such damper devices typically employ circular or elliptically shaped damper plates which are rotated about an axis traversing a circularly or elliptically shaped duct, the motive means for producing rotation of the circularly or elliptically shaped damper plate being typically electrically powered, or thermally powered, as by means of bimetallic elements which respond to the temperature of the gases flowing through the duct being regulated by the damper device.

As is evident from a consideration of FIG. 1, circular or elliptical damper plates of the type already known in the prior art are not suitable for use in a rectangular flue, such as described in reference to FIG. 1.

In marked departure to the damper constructions of the prior art the drawings illustrate a uniquely constructed damper assembly. Illustrated in the drawings is a damper assembly suitable for retrofit installation into a pre-existing draft hood. As will be explained later, however, a damper assembly in accordance with the present invention can be installed as original equipment by the manufacturer of the draft hood and in such cases the construction of the damper assembly illustrated in the drawings substantially simplified.

Figure 4:
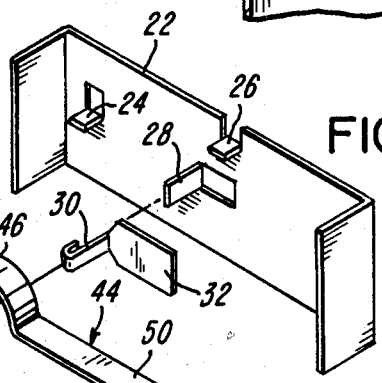
FIG. 4 is an exploded perspective view illustrating the thermally responsive damper assembly of the present invention.

As illistrated in FIG. 4, the damper assembly comprises a channel member 22 having struck upwardly from its base a strike out or post 24 which will determine a damper closing position, a strike out or post 26 for determining a full open position for the damper and a somewhat longer strike out which will function as a supporting shaft 28 for a bimetallic coil yet to be described.

The shaft 28 is sized to interfit a hook portion formed on a latch member or post 30 which is one piece with a latch plate 32.

Adapted for assembly on to the shaft 28 and the interfitting latch member 30 is a bimetallic coil 34 comprising a convoluted strap of metal which consists of facially bonded, normally metal, strips having differing responses to differing temperatures, whereby the coil 34 tends to unwind with increasing temperature and tends to wind more tightly upon itself with decreasing temperatures. The convolutions of the coil 34 wind generally circular, one about the other, except that the innermost convolution 36 is bent angularly near its free end to form a flange 38 which will essentially partition the space surrounded by innermost convolution. The outermost convolution 40 has a sharp angular bend near the free end thereof defining a tab 42 which extends radially outwardly from the coil 34 and is disposed essentially perpendicular to the flange 38 of the innermost convolution. Partially surrounding the coil 34 is a damper vane 44. The vane 44 comprises an arcuate web 46 located at the center of the vane and from the ends of which extend integrally formed wings 48 and 50. Passing through the wing 48 near its juncture with the arcuate web 46 is an aperture 52 which can be aligned with an aperture 54 passing through the tab 42. In assembly a rivet 56 is used to affix the vane 44 to the tab 42 in such fashion that the arcuate web 46 wraps nearly 180° I around the outermost convolution 40 of the coil 34.

The coil 34 is assembled to the channel member 22 as follows. After the vane 44 has been riveted to the coil 34 as described, the latch member or post 30 is pushed into the space surrounded by the inner most convolution 36 of the coil 34 and hooks to the flange 38 of the innermost convolution 36. With the latch member 30 thus hooked to the coil 34, the coil 34 and latch member 30 are slided in unison onto the shaft 28 to cause the free end of the shaft 28 to enter the hook portion of the latch member 30 alongside the flange 38.

Figure 5:
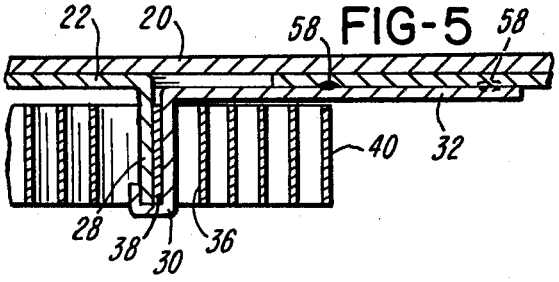
FIG. 5 is a fragmentary section view taken substantially along the line 5—5 of FIG. 3.

At this point, the latch member 30, coil 34 and the vane 44 are loosely assembled to the shaft 28. This loose assembly of parts is now rendered secure by spot welding or otherwise fastening the latch plate 32 to the base of the channel member 22 as shown at 58 in FIG. 5. At the time the spot welding is accomplished, care is taken to assure that the wing 48 of the vane 44 projects through the space between the strike outs 24 and 26 and to assure that the winding of the bimetallic coil 34 is such that increasing temperatures will expand the coil 34 in a manner which will advance the wing 48 toward the strike out 26, whereas cooling temperatures will cause the coil 34 to contract in a fashion which draws the wing 48 from the strike out 26 toward the strike out 24.

After the foregoing assembly is completed, the assembly is fitted into the flue section 20 of the draft hood 10. For the position of assembly illustrated in FIG. 1, the sides of the channel member 22 are spot welded, as shown at 60 in FIG. 5, to the sides of the U-shaped piece 12.

Figure 2:
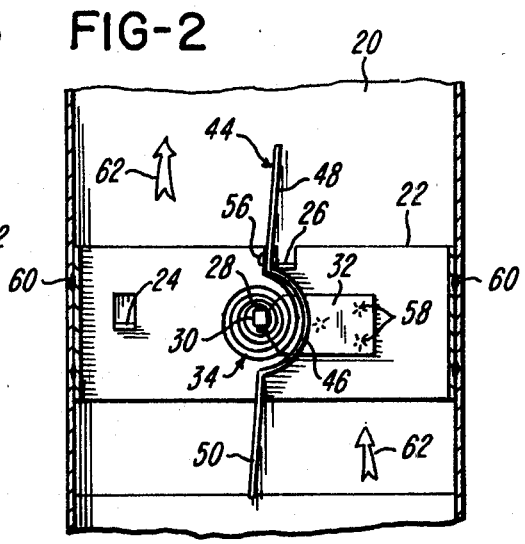
FIG. 2 is a fragmentary section view taken substantially along the line 2—2 of FIG. 1.
Figure 3:
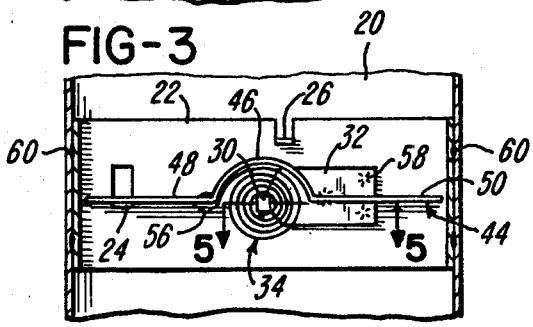
FIG. 3 is a fragmentary illustration analogous to that of FIG. 2 but showing the thermally responsive damper assembly in a different operating position.

FIG. 2 illustrates the damper assembly as mounted within the flue section 20 of the draft hood 10 at a time when the gases passing through the draft hood, as indicated by the arrows 62, are relatively hot and, in consequence of their temperature, have heated the bimetallic coil so as to drive the wing 48 against the strike out 26, this being a substantially full open position of the vane 44 in respect of the flue section 20. FIG. 3 correspondingly illustrates the same assembly long after the discharge of combustion products to the draft hood 10 has been terminated and at a time when the temperature of the bimetallic coil 34 has decreased substantially, thus to draw the wing 48 firmly against the strike out 24. FIG. 2 thus shows the damper assembly at a time when combustion is occurring and the ventilation of combustion products has been maximized, whereas FIG. 3 illustrates the damper assembly after combustion has been terminated and at a time when further ventialtion of gases through the draft hood has been minimized.

The illustrated damper assembly has all of its components mounted to a single channel member 22 sized with side walls which enable the damper assembly to be slided into the flue 20, illustrated in FIG. 1, and in this contruction it can be noted that the axle shaft 28, as well as the motion limiting strike outs 24 and 26, are conveniently derived from the body of the channel member 22. Those skilled in the art will appreciate, however, that the use of the channel member 22 and the strike outs 24, 26 and shaft 28 are merely matters of convenience to the construction of a damper assembly which can be conveniently fitted into a pre-existing draft hood, such as illustrated in FIG. 1. Alternatively, one can mount axle means and position limiting members directly on a portion of the draft hood, such as the piece 12, and thereby avoid the use of strike out portions such as illustrated in FIG. 4. Thus, if strike out portions are to be used, the present damper assembly is preferably inserted into an already complete duct. If strike out portions need not be used the various components comprising the damper assembly may be mounted directly on imperforate duct surfaces.

The preferred embodiment described above in relation to FIGS. 1–5 contemplates use of the vane 44 sized so that the tips of its wings 48 and 50 do not physically contact the sides of the duct 20 when the vane 44 is in its duct closing position illustrated in FIG. 3. In some applications for damper devices of the type being described, it is preferred to extend the wings of the damper vane 44 so that the tips of the wings will stop the vane rotation before the vane can reach the horizontal position illustrated in FIG. 3. Such a construction eliminates the need for the post or strike out 24 illustrated for example in FIG. 4, since the sides of the duct 20 coacting with the tips of the wings 48 and 50 will perform the motion limiting function supplied by the post or strike out 24 of the preferred embodiment.

Figure 6:
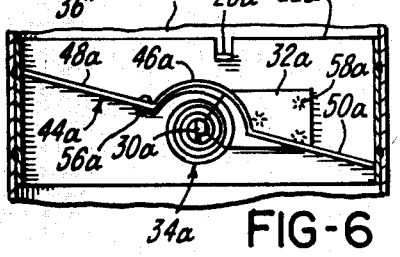
FIG. 6 is a fragmentary illustration analogous to FIG. 3 and illustrating a modification wherein the vane is oversized in relation to the duct in which the vane operates.

A schematic illustration of a damper whose vane is oversized in terms of its length so as to stop rotation before the vane reaches the horizontal position of FIG. 3 appears in FIG. 6, wherein the vane has been given the reference number 44*a* and all reference numbers appearing in FIG. 6 have been identified with the suffix "a" to distinguish such reference numbers from those appearing in FIGS. 1–5, and the reference numbers of FIG. 6 identifying components of FIG. 6 which function substantially the same as those of FIGS. 1–5 identified by the same Arabic reference character.

Although the preferred embodiments of this invention have been described, it will be understood that various changes may be made within the scope of the appended claims.

Having thus described our invention, we claim:

1. A damper assembly for operation between confronting side faces of a flue comprising, in combination, a vane disposed between said side faces and having a width substantially equal to the separation between said side faces, axle means generally perpendicular to said side faces and projecting through the space between said side faces, bimetallic coil means convoluted about said axle means, and means cooperating with said axle means to retain the innermost convolution of said coil means against rotation about said axle means, means affixing said vane to the outermost convolution of said coil means, said vane having first and second wing portions projecting outwardly and oppositely from said coil means, said wing portions disposed generally radially with respect to said axle means and orbited about said axle means in response to changing temperatures of said coil means causing the outermost convolution of said coil means to progress circumferentially about the innermost convolution of said coil means.

2. The damper assembly of claim 1 including a post extending into the space between said side faces from at least one of said side faces, said post defining an open position to which said vane is driven by said coil means in response to an increasing temperature of said coil means.

3. The damper assembly of claim 1 wherein said confronting side faces are planar and parallel each to the other.

4. The damper assembly of claim 1 wherein one of said side faces is a channel member having a base portion extending between upright side walls of said channel member and wherein said post is struck upwardly from said base porion between said side walls.

5. The damper assembly of claim 4 wherein the other of said side faces is an integral portion of said duct.

6. The damper assembly of claim 4 wherein said axle means is a strike-out from said base portion.

7. The damper assembly of claim 1 wherein said vane comprises an arcuate web integrally joined at the ends of said web to ends of said wing portions.

* * * * *

UNITED STATES PATENT AND TRADEMARK OFFICE

CERTIFICATE OF CORRECTION

PATENT NO. : 4,361,272

DATED : November 30, 1982

INVENTOR(S) : John Prikkel, III, et al.

It is certified that error appears in the above-identified patent and that said Letters Patent are hereby corrected as shown below:

Column 2, line 37, "fraft" should be ---draft---.

Column 3, line 47, "illistrated" should be ---illustrated---.

Column 4, line 64, "ventialtion" should be ---ventilation---.

Column 6, line 38, "porion" should be ---portion---.

Signed and Sealed this

First Day of March 1983

[SEAL]

*Attest:*

GERALD J. MOSSINGHOFF

*Attesting Officer*

*Commissioner of Patents and Trademarks*